US010701970B2

(12) United States Patent
Mishra et al.

(10) Patent No.: US 10,701,970 B2
(45) **Date of Patent: *Jul. 7, 2020**

(54) ETHANOL-FREE GEL FORMULATION CARTRIDGE FOR E-VAPING DEVICE

(71) Applicant: Altria Client Services LLC, Richmond, VA (US)

(72) Inventors: Munmaya K. Mishra, Manakin Sabot, VA (US); Shaoyong Yu, Henrico, VA (US); Raymond Lau, Richmond, VA (US); Pauline Marcq, Richmond, VA (US); Geoffrey Brandon Jordan, Midlothian, VA (US); Christopher S. Tucker, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 478 days.

This patent is subject to a terminal disclaimer.

(21) Appl. No.: 14/927,072

(22) Filed: Oct. 29, 2015

(65) Prior Publication Data

US 2016/0120225 A1 May 5, 2016

Related U.S. Application Data

(60) Provisional application No. 62/072,076, filed on Oct. 29, 2014.

(51) Int. Cl.
*A24F 47/00* (2020.01)

(52) U.S. Cl.
CPC ..... *A24F 47/008* (2013.01)

(58) Field of Classification Search
CPC .... A24F 47/008; A24F 47/002; A24F 47/004; A24F 13/22; A24F 17/00; A24F 47/006
(Continued)

(56) References Cited

U.S. PATENT DOCUMENTS 1,674,558 A 6/1928 Miller
3,356,094 A 12/1967 Ellis et al.
(Continued)

FOREIGN PATENT DOCUMENTS

CN 101731757 A 12/2011
CN 102960852 A 3/2013
(Continued)

OTHER PUBLICATIONS

English Translation of CN 103960783 A (Year: 2014).*
(Continued)

*Primary Examiner* — Ibrahime A Abraham
*Assistant Examiner* — Chris Q Liu
(74) *Attorney, Agent, or Firm* — Harness, Dickey & Pierce, P.L.C.

(57) ABSTRACT

A cartridge for an e-vaping device includes an ethanol-free gel formulation. The ethanol-free gel formulation includes a vapor former, water, and a biopolymer. The biopolymer may be included in an amount ranging from about 0.01% by weight based on the weight of the ethanol-free gel formulation to about 2.0% by weight based on the weight of the ethanol-free gel formulation. The biopolymer may be one or more of agar, kappa carrageenan, gelatin, sodium alginate, gellan gum, pectin, and combinations thereof. The cartridge also includes a heater configured to heat liquid from the gel formulation to a temperature sufficient to release a liquid/semi-liquid component from the gel, which component thereupon forms a vapor.

19 Claims, 7 Drawing Sheets

(58) Field of Classification Search
USPC ..... 392/386, 394, 395, 404; 131/273; 128/200.14
See application file for complete search history.

(56) References Cited

U.S. PATENT DOCUMENTS

| | | | | |
|---|---|---|---|---|
| 4,981,608 | A | 1/1991 | Gunther | |
| 5,240,016 | A * | 8/1993 | Nichols | A24F 47/004 131/194 |
| 7,600,518 | B2 | 10/2009 | Oglesby et al. | |
| 8,714,161 | B2 | 5/2014 | Liu | |
| 2007/0082059 | A1 | 4/2007 | Duneas et al. | |
| 2009/0235941 | A1 | 9/2009 | Chida et al. | |
| 2012/0000481 | A1 | 1/2012 | Potter et al. | |
| 2012/0037172 | A1 | 2/2012 | Allen et al. | |
| 2013/0037041 | A1 | 2/2013 | Worm et al. | |
| 2013/0160765 | A1 | 6/2013 | Liu | |
| 2013/0192620 | A1 | 8/2013 | Tucker et al. | |
| 2013/0192622 | A1 | 8/2013 | Tucker et al. | |
| 2013/0192623 | A1* | 8/2013 | Tucker | H01C 17/00 131/329 |
| 2013/0255702 | A1 | 10/2013 | Griffith, Jr. et al. | |
| 2014/0060554 | A1 | 3/2014 | Collett et al. | |
| 2014/0064715 | A1 | 3/2014 | Greim et al. | |
| 2014/0088045 | A1 | 3/2014 | Rigas et al. | |
| 2014/0150785 | A1 | 6/2014 | Malik et al. | |
| 2014/0251354 | A1 | 9/2014 | Zheng | |
| 2014/0261486 | A1 | 9/2014 | Potter et al. | |
| 2015/0013701 | A1 | 1/2015 | Liu | |
| 2015/0020822 | A1 | 1/2015 | Janardhan et al. | |
| 2015/0027454 | A1 | 1/2015 | Li et al. | |
| 2015/0027455 | A1 | 1/2015 | Peleg et al. | |
| 2015/0027464 | A1 | 1/2015 | Liu | |
| 2015/0027468 | A1 | 1/2015 | Li et al. | |
| 2015/0059784 | A1 | 3/2015 | Llu | |

FOREIGN PATENT DOCUMENTS

| | | | |
|---|---|---|---|
| CN | 203378563 | U | 1/2014 |
| CN | 103960783 | A | 8/2014 |
| CN | 103960784 | A | 8/2014 |
| EP | 0845220 | A1 | 6/1998 |
| EP | 1897628 | A1 | 3/2008 |
| WO | WO-2011054516 | A2 | 5/2011 |
| WO | WO-2011/117752 | A2 | 9/2011 |
| WO | WO-2012/019533 | A1 | 2/2012 |
| WO | WO-2013116572 | A1 | 8/2013 |
| WO | WO-2013128176 | A1 | 9/2013 |

OTHER PUBLICATIONS

Search Report for corresponding European Application No. 15853808.2 dated Jun. 6, 2018.
Office Action for corresponding Eurasian Application No. 201790936 dated May 31, 2018 and English translation thereof.
International Search Report and Written Opinion dated Jan. 14, 2016 issued in International Application No. PCT/US2015/058018.
International Preliminary Report on Patentability and Written Opinion dated May 11, 2017, issued in International Application No. PCT/US2015/058018.
Office Action for corresponding Eurasian Application No. 201790936 dated Dec. 13, 2018 and English translation thereof.
Chinese Office Action dated May 31, 2019 for corresponding Chinese Application No. 201580060069.6.
Extended European Search Report dated Sep. 27, 2019 for corresponding European Application No. 19171160.5.
Israeli Official Notification dated Feb. 20, 2020 in Israeli Application No. 251446.
Transmittal of International Search Report and Written Opinion from corresponding International Application No. PCT/US2015/058075, dated Jan. 14, 2016.
Notification of Transmittal of International Search Report and Written Opinion and International Search Report and Written Opinion, dated Nov. 29, 2018.
International Search Report end Written Opinion from corresponding international application PCT/US2015/058075, dated May 2, 2017.
U.S. Office Action dated Jun. 14, 2017 in U.S. Appl. No. 14/926,878.
U.S. Office Action dated Nov. 29. 2017 in U.S. Appl. No. 14/926,878.
Extended European Search Report dated Jun. 14, 2018 in related EP Application No. 158540140.1.
Eurasian Office Action dated Jan. 15, 2019 in corresponding Eurasian Application No. 201790930, with an English translation.
Chinese Office Action dated Aug. 14, 2019 in corresponding Chinese Application 201580059390.2, with an English language translation.
U.S. Office Action dated May 17, 2018 in U.S. Appl. No. 14/926,878.
U.S. Office Action dated Dec. 5, 2018 in U.S. Appl. No. 14/926,878.
U.S. Office Action dated Oct. 7, 2019 in U.S. Appl. No. 14/926,878.
U.S. Notice of Allowance dated Jan. 29, 2020 in U.S. Appl. No. 14/926,878.
Extended European Search Report dated Sep. 18, 2018 issued in corresponding European Application No. 15853808.2-1105/3212017.
Chinese Office Action dated Feb. 27, 2020 for corresponding Chinese Application No. 201580060069.6.
Office Action dated Mar. 5, 2020 in Ukraine Application No. a201911464.
Eurasian Notification dated May 14, 2020 for corresponding Eurasian Application No. 201790936.

* cited by examiner

ETHANOL-FREE GEL FORMULATION CARTRIDGE FOR E-VAPING DEVICE

PRIORITY STATEMENT

This application is a non-provisional application that claims priority to U.S. provisional app. No. 62/072,076, filed on Oct. 29, 2014, the entire content of which is incorporated by reference in its entirety.

BACKGROUND

Field of the Invention

Example embodiments relate generally to an e-vaping device that may be operable to deliver a pre-vapor formulation from a supply reservoir to a heater. The heater may volatilize the pre-vapor formulation to form a vapor.

Related Art

E-vaping devices, also referred to herein as electronic vaping devices (EVDs) may be used by adult vapers as a portable means of vaping. Flavor systems within an e-vaping device may be used to deliver a pleasurable flavor to the adult vaper along with the vapor that may be produced by the e-vaping device.

In some cases, over extended periods of time a loss of flavoring from a flavor system may occur, thereby reducing a shelf-life of the flavor system. A loss of flavoring may also occur when the flavor system is exposed to a heat source. Such a loss of flavoring from a flavoring system may reduce a sensory experience of the adult vaper using an e-vaping device in which the flavoring system is included.

SUMMARY

According to some example embodiments, a cartridge for an e-vaping device may include an ethanol-free gel formulation and a heater configured to heat the ethanol-free gel formulation to form a vapor. The ethanol-free gel formulation may include a vapor former, water, and a biopolymer. The biopolymer may be included in an amount ranging from about 0.01% by weight based on the weight of the ethanol-free gel formulation to about 2.0% by weight based on the weight of the ethanol-free gel formulation. The biopolymer may be one or more of agar, kappa carrageenan, gelatin, sodium alginate, gellan gum, pectin, and combinations thereof.

According to some example embodiments, the biopolymer may be included in an amount ranging from about 0.2% by weight based on the weight of the ethanol-free gel formulation to about 0.4% by weight based on the weight of the ethanol-free gel formulation.

According to some example embodiments, the vapor former may be included in the ethanol-free gel formulation in an amount ranging from about 40% by weight based on the weight of the ethanol-free gel formulation to about 90% by weight based on the weight of the ethanol-free gel formulation.

According to some example embodiments, the vapor former may be included in the ethanol-free gel formulation in an amount ranging from about 50% by weight based on the weight of the ethanol-free gel formulation to about 80% by weight based on the weight of the ethanol-free gel formulation.

According to some example embodiments, the water may be included in the ethanol-free gel formulation in an amount ranging from about 5% by weight based on the weight of the ethanol-free gel formulation to about 40% by weight based on the weight of the ethanol-free gel formulation. The water may be included in the ethanol-free gel formulation in an amount ranging from about 10% by weight based on the weight of the ethanol-free gel formulation to about 15% by weight based on the weight of the ethanol-free gel formulation.

According to some example embodiments, the ethanol-free gel formulation may include a flavorant. The flavorant may be included in the ethanol-free gel formulation in an amount ranging from about 0.2% by weight based on the weight of the ethanol-free gel formulation to about 15% by weight based on the weight of the ethanol-free gel formulation. The flavorant may include at least one of a natural flavorant or an artificial flavorant. The flavorant may be one or more of tobacco flavor, menthol, wintergreen, peppermint, herb flavors, fruit flavors, nut flavors, liquor flavors, and combinations thereof.

According to some example embodiments, the ethanol-free gel formulation may include nicotine. The nicotine may be included in the ethanol-free gel formulation in an amount ranging from about 1% to about 10% by weight based on the weight of the ethanol-free gel formulation. The nicotine may be included in the ethanol-free gel formulation in an amount ranging from about 1.5% to about 4.5% by weight based on the weight of the ethanol-free gel formulation.

According to some example embodiments, the ethanol-free gel formulation may include nicotine in an amount of at least about 3% by weight based on the weight of the ethanol-free gel formulation, and the ethanol-free gel formulation may include an acid in an amount ranging from about 0.01% by weight based on the weight of the ethanol-free gel formulation to about 5.0% by weight based on the weight of the ethanol-free gel formulation, the acid is one or more of pyruvic acid, formic acid, oxalic acid, glycolic acid, acetic acid, isovaleric acid, valeric acid, propionic acid, octanoic acid, lactic acid, levulinic acid, sorbic acid, malic acid, tartaric acid, succinic acid, citric acid, benzoic acid, oleic acid, aconitic acid, butyric acid, cinnamic acid, decanoic acid, 3,7-dimethyl-6-octenoic acid, 1-glutamic acid, heptanoic acid, hexanoic acid, 3-hexenoic acid, trans-2-hexenoic acid, isobutyric acid, lauric acid, 2-methylbutyric acid, 2-methylvaleric acid, myristic acid, nonanoic acid, palmitic acid, 4-penenoic acid, phenylacetic acid, 3-phenylpropionic acid, hydrochloric acid, phosphoric acid, sulfuric acid and combinations thereof.

According to some example embodiments, at least a portion of the biopolymer may be cross-linkable.

According to some example embodiments, the ethanol-free gel formulation may include a diol and glycerin, the ethanol-free gel formulation including the diol and glycerin in a range of ratios between about 1:4 and 4:1, the diol being one of propylene glycol, glycerin, 1,3-propanediol, and combinations thereof. The ethanol-free gel formulation may include diol and glycerin in a ratio of about 3:2.

According to some example embodiments, the ethanol-free gel formulation may be included in a cylindrical body.

According to some example embodiments, the heater may be at least one of: a wire coil heater contacting a surface of the cylindrical body; a surface planar heater contacting a planar surface of the cylindrical body; a ring-shaped planar heater contacting a planar surface of the cylindrical body; a serpentine heater contacting a surface of the cylindrical body; a coil heater at least partially wrapped around a circumference of the cylindrical body; a conformal planar surface heater contacting a portion of an outer circumference of the cylindrical body; a conformal ring surface heater extending around the circumference of the cylindrical body; or an inductive coil heater isolated from contacting a surface of the cylindrical body.

According to some example embodiments, the ethanol-free gel formulation may be included in a tubular body, the tubular body including a hollow core. The heater may extend at least partially through the hollow core, and the heater may be configured to heat the ethanol-free gel formulation to form a vapor in the hollow core.

According to some example embodiments, the heater may be at least one of a heater coil, a planar heater, or a heater rod.

According to some example embodiments, an e-vaping device may comprise a first section and a second section. The first section may include a reservoir containing an ethanol-free gel formulation and a heater configured to heat the ethanol-free gel formulation to form a vapor. The ethanol-free gel formulation may include a vapor former, water, and a biopolymer. The biopolymer may be included in an amount ranging from about 0.01% by weight based on the weight of the ethanol-free gel formulation to about 2.0% by weight based on the weight of the ethanol-free gel formulation. The biopolymer may be one or more of agar, kappa carrageenan, gelatin, sodium alginate, gellan gum, pectin, and combinations thereof. The second section may include a power supply and control circuitry. The power supply may be configured to supply electrical power to the heater. The control circuitry may be configured to control a supply of the electrical power to the heater.

According to some example embodiments, the first and second sections may include respective interfaces. The interfaces may be configured to couple the first section and the second section together. The interfaces may be configured to electrically couple the heater to the power supply.

According to some example embodiments, a method of manufacturing a cartridge for an e-vaping device may comprise placing a pre-vapor formulation into a reservoir and cooling the pre-vapor formulation to form an ethanol-free gel formulation in the reservoir. The ethanol-free gel formulation may include a vapor former, water, and a biopolymer in an amount sufficient to form a self-sustaining shaped gel. The biopolymer may be one or more of agar, carrageenan, gelatin, sodium alginate, gellan gum, pectin, and combinations thereof.

According to some example embodiments, the biopolymer may be in an amount ranging from about 0.01% by weight based on the weight of the ethanol-free gel formulation to about 2.0% by weight based on the weight of the ethanol-free gel formulation.

According to some example embodiments, the method may further comprise: forming the pre-vapor formulation prior to placing the pre-vapor formulation into a reservoir. The forming may include dissolving the biopolymer in hot water having a temperature of about 99.9° C. while stirring to form a clear solution, mixing the water and the vapor former to form a liquid system, preheating the liquid system to a temperature of about 60° C. to form a warm liquid system, and adding the warm liquid system to the clear solution while mixing for about 10 minutes to form the pre-vapor formulation as a final homogenous mixture.

According to some example embodiments, cooling the pre-vapor formulation to form the ethanol-free gel formulation may include cooling the final homogenous mixture to a temperature of about 4° C. for about one hour to form a gel.

According to some example embodiments, an apparatus may comprise: a surface heater in contact with a surface of a pre-vapor formulation. The heater may be configured to heat the pre-vapor formulation to form a vapor.

According to some example embodiments, the pre-vapor formulation may be a cylindrical body.

According to some example embodiments, the surface heater may be at least one of, a wire coil heater contacting a surface of the cylindrical body, a surface planar heater contacting a planar surface of the cylindrical body, a ring-shaped planar heater contacting a planar surface of the cylindrical body, a serpentine heater contacting a surface of the cylindrical body, a coil heater at least partially wrapped around a circumference of the cylindrical body, a conformal planar surface heater contacting a portion of an outer circumference of the cylindrical body, or a conformal ring surface heater extending around the circumference of the cylindrical body.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
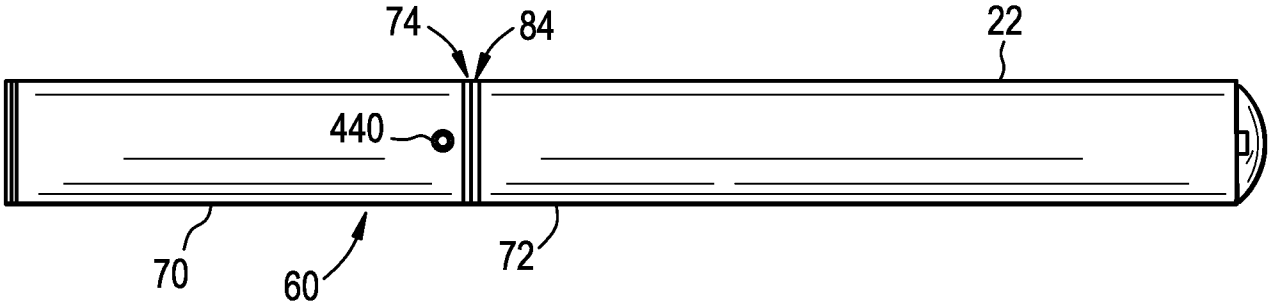
FIG. 1 is a top planar view of an e-vaping device, according to some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one or more of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

When the word "about" is used in this specification in connection with a numerical value, it is intended that the associated numerical value includes a tolerance of ±10% around the stated numerical value (or range of values). Moreover, when reference is made to percentages in this specification, it is intended that those percentages are based on weight (i.e., weight percentages). The expression "up to" includes amounts of zero to the expressed upper limit and all values therebetween. When ranges are specified, the range includes all values therebetween such as increments of 0.1%.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

As described herein, an e-vaping device may include a pre-vapor formulation configured to be heated by a heater to form a vapor. The pre-vapor formulation may include a gel formulation. The gel formulation may include a hydrogel formulation. The gel formulation may include a semi-rigid, jelly-like material that sustains a shape at ambient conditions and is capable of releasing a liquid or a semi-liquid when heated to temperatures of at least 40° C. In some example embodiments, a gel formulation does not leak liquid when maintained in a reservoir of an e-vaping device under ambient conditions. In some example embodiments, the gel formulation maintains its shape independent of a reservoir in which it is contained at ambient conditions. In some example embodiments, the gel formulation includes a vapor former, water, and at least one biopolymer in an amount sufficient to form a gel. In some example embodiments, the gel formulation includes at least one or more of nicotine and one or more flavorants.

As used herein, the term "flavorant" is used to describe a compound or combination of compounds that may provide flavor and/or aroma to an adult vaper.

As used herein, the terms "gel" and "hydrogel" are used to describe a gelled, semi-rigid or semi-solid colloidal dispersion of a solid with a liquid that is capable of sustaining a shape at ambient conditions and releasing a liquid and/or semi-liquid component thereof upon heating to about 40° C. or above.

As used herein, the term "semi-liquid" refers to a fluid having a thick, viscous consistency between a solid and a liquid.

As used herein, the term "e-vaping device" is inclusive of all types of electronic vaping devices, regardless of form, size or shape.

The gel formulation may include nicotine or may exclude nicotine. The gel formulation may include one or more tobacco flavors. The gel formulation may include one or more flavors which are separate from one or more tobacco flavors.

FIG. 1 is a top planar view of an e-vaping device 60, according to some example embodiments. The e-vaping device may generally be formed of at least two components (or sections): a first section 70 that may be a replaceable section and a section 72 that may be a reusable fixture including a power supply. The first section 70 may be referred to, in some example embodiments, as a "cartridge" 70.

In some example embodiments, both sections 70 and 72 may be disposable. Both of the sections 70 and 72 may be enclosed by a housing 22. The outer housing 22 may be formed of any suitable material or combination of materials. The outer housing 22 may be cylindrical and may be formed at least partially of metal and may be part of an electrical circuit. Although the housing is described herein as cylindrical, other forms and shapes are also contemplated.

The sections 70 and 72 may be coupled together by respective interfaces 74, 84. The interfaces 74, 84 may include one or more of a threaded joint, a snug-fit connection, a snap-fit connection, a detent, a clamp or a clasp. In some example embodiments, the two sections 70/72 may be one single section (that may be disposable), such that a joint 74 is absent. In some example embodiments, the interface 74 includes an electrode which is coupled to one or more heaters 319 included in the first section 70, the interface 84 includes an electrode which is coupled to one or more power supplies 12 included in the second section 72, and the interfaces 74, 84 are further configured to electrically couple the one or more heaters to the power supply 12 based on the sections 70, 72 being coupled together via the interfaces 74, 84. One or more openings 440 may be included in the first section 70. The one or more openings 440 may include one or more air inlets. It should be understood that the general configuration of the e-vaping device 60 shown in FIG. 1 (showing an outer-view of the e-vaping device 60) may be implemented for any of the embodiments of FIGS. 2-6 (which depict detailed cross-sectional views of various example embodiments of e-vaping devices).

Figure 2:
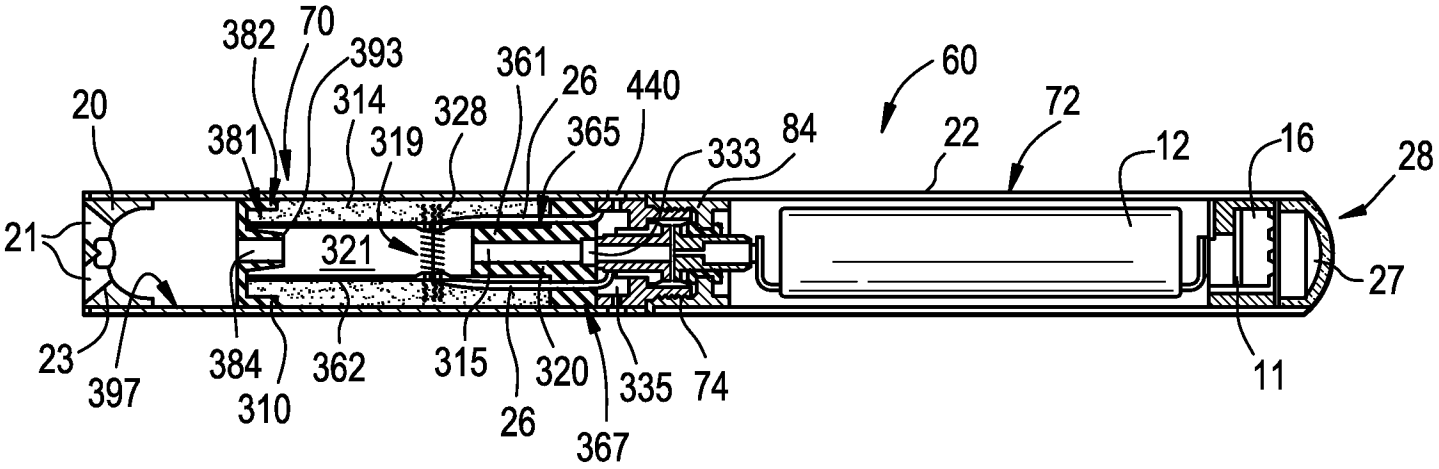
FIG. 2 is a side cross-sectional view of an e-vaping device, according to some example embodiments.

FIG. 2 is a side cross-sectional view of an e-vaping device, according to some example embodiments. The first section 70 may extend in a longitudinal direction with an inner tube (or chimney) 362 coaxially positioned within the outer housing 22. The first section 70 may include a mouth-end insert 20 at one end, with outlets 21 located at ends of off-axis passages angled outwardly in relation to a longitudinal direction of the e-vaping device 60. In some example embodiments, there may be only a single centrally located outlet 21.

The first section 70 may include one or more of a heater 319, a flexible, filamentary wick 328, a reservoir 314 configured to contain a gel formulation, and an interface 74. The second section 72 may include one or more of a power supply 12, a control circuitry 11, a puff sensor 16, a heater activation light 27, a coal end cap 28, and an interface 84. The interfaces 74, 84 may be configured to couple with each other to couple the first and second sections 70, 72 together to form the e-vaping device 60. The first section 70 and the second section 72 may include the outer housing 22 extending in a longitudinal direction along a length of the e-vaping device 60. In some example embodiments, the e-vaping device 60 may be disposable and includes only one section (not shown). In some example embodiments, the e-vaping device 60 may include an actuator button that may be pressed to initiate a heating cycle of the heater 319.

In some example embodiments, the e-vaping device 60 may include a heater 319 and a filamentary wick 328 as shown in FIG. 2. The first section 70 may include the outer tube (or housing) 22 extending in a longitudinal direction and an inner tube (or chimney) 362 coaxially positioned within the outer tube 22.

In some example embodiments, a nose portion 361 of a gasket (or seal) 320 may be fitted into an end portion 365 of the inner tube 362, where an outer perimeter 367 of the gasket 320 may provide a liquid-tight seal with an interior surface 397 of the outer housing 22. The gasket 320 may also include a central, longitudinal conduit 315, which may open into an interior of the inner tube 362 to define a central channel 321. A transverse channel 333 at a portion of the gasket 320 may intersect and communicate with the central, longitudinal conduit 315 and a space 335 defined between the gasket 320 and an interface 74.

In some example embodiments, a nose portion 393 of a gasket 310 is fitted into an end portion 381 of the inner tube 362. An outer perimeter 382 of the gasket 310 may provide a substantially liquid-tight seal with the interior surface 397 of the outer housing 22. The gasket 310 includes a central channel 384 disposed between the central passage 321 of the inner tube 362 and the mouth end insert 20.

A reservoir 314 may be contained in an annulus between the inner tube 362 and the outer housing 22, and between the gasket 320 and the gasket 310. Thus, the reservoir 314 may at least partially surround the central conduit 321. The reservoir 314 may contain a pre-vapor formulation. The pre-vapor formulation may be a gel formulation. It will be understood that aspects of a gel formulation described herein may also be aspects of a pre-vapor formulation even though not explicitly described as such. The reservoir may also include a storage medium (not shown), including one or more of a fibrous and/or gauze structure, configured to suspend the gel formulation. In some example embodiments, the reservoir 314 contains the gel formulation independently of including a liquid storage medium or a liquid at ambient conditions.

In some example embodiments, the reservoir 314 may be a tank reservoir with at least one side wall, a bottom wall, a top wall, and an opening in one or more of the walls through which the gel formulation may be injected. In some example embodiments, liquid produced during heating of the gel formulation may be wicked from the reservoir through the opening.

A heater 319 may extend through the central conduit 321 of the inner tube 362. The heater 319 may extend transversely through the central conduit 321. Electrical leads 26 may be electrically connected to the heater in order to energize the heater when the device 60 is actively being used by an adult vaper. In some example embodiments, one or more of the electrical leads extend to an interface 74 of the first section. The interface 74 may be configured to couple the first section 70 with the second section 72. The interface 74 may be configured to couple with an interface 84 of the second section to couple the first and second sections 70, 72. The interface 74 may be coupled to the heater 319 via the one or more electrical leads 26, and the interface 84 may be coupled to the power supply 12 via one or more electrical connections. In some example embodiments, coupling the interfaces 74, 84 together electrically couples the heater 319 of the first section 70 to the power supply 12 of the second section.

The heater 319 may be in contact with the filamentary wick 328, which may extend between opposing sections of the reservoir 314 so as to deliver the pre-vapor formulation from the reservoir 314 to the heater 319. Delivering the pre-vapor formulation from the reservoir 314 to the heater 319 may include wicking a liquid or a semi-liquid component from the gel formulation from the reservoir 314 to the heater 319 when the heater 319 is operated and heats a portion of the gel formulation to a temperature above ambient. As a liquid or semi-liquid component is wicked from the gel formulation, a polymer included in the gel formulation may remain in the gel formulation, and the liquid or semi-liquid component may be volatilized by the heater 319 to form a vapor. Where the first section 70 includes the reservoir 314, and the gel formulation is included in the reservoir, the polymer may remain in the reservoir as the liquid or semi-liquid component is wicked from the gel formulation. The e-vaping device 60 may include at least one opening 440 arranged distal from the mouth-end insert 20 relative to the heater 319.

The second section 72 may include a power supply 12, which may be a battery that is either disposable or rechargeable. The power supply 12 may be operable to apply a voltage across the heater 319. Thus, the heater 319 may volatilize the pre-vapor formulation according to a power cycle of a time period. The time period may be a particular time period, including a 2 to 10 second period. The second section 72 may include a puff sensor 16 with control circuitry 11 which may be on a printed circuit board. The control circuitry 11 may also include a heater activation light 27 that may be operable to glow when the heater 319 is activated. The end cap 45 may be positioned on a distal end of the second section 72.

The power supply 12 may include a battery arranged in the e-vaping device 60. The power supply 12 may be configured to apply voltage across the heater 319 associated with the filamentary wick 328. The power supply may be coupled to an interface 84 of the second section 72, such that coupling interface 84 with interface 74 of the first section 70 electrically couples the power supply 12 to a heater 319 that is coupled to the interface 74. The heater may heat the gel formulation to a temperature sufficient to cause a liquid or semi-liquid to wick from the ethanol-free gel formulation via capillary action. Thus, the heater 319 may volatilize the gel formulation according to a power cycle of a particular time period, including a 2 to 10 second period. The battery may be disposable or rechargeable. The teachings herein are applicable to any type of battery and any type of power cycle.

In some example embodiments, the e-vaping device 60 also includes control circuitry 11 which may be on a printed circuit board. The control circuitry 11 may also include the heater activation light 27, including a light emitting diode (LED), that is configured to glow when the heater 319 is activated. In some example embodiments, the control circuitry 11 is configured to control a supply of electrical power to one or more heaters included in the e-vaping device. For example, the control circuitry 11 may selectively supply electrical power from the power supply 12 to the heater 319 to control a heating cycle of the heater 319. In another example, the control circuitry 11 may selectively supply electrical power from the power supply 12 to the heater 319 based on adult vaper interaction with one or more user interfaces included in the e-vaping device, including an activation button. In some example embodiments, the control circuitry may selectively supply electrical power from the power supply 12 to the heater 319 based on a signal received from puff sensor 16, where the puff sensor 16 may generate the signal based on a pressure change detected by the puff sensor 16.

The outer housing 22 of the e-vaping device 60 may be formed of any suitable material or combination of materials. In some example embodiments, the outer housing 22 is cylindrical and is formed at least partially of metal and is part of the electrical circuit. Although the housing is described herein as cylindrical, other forms and shapes are contemplated.

In some example embodiments, the gel formulation may be formed by combining a vapor former, water, and a biopolymer. In some example embodiments, the gel formulation may be formed by further combining one or more of flavors, aromas, or nicotine. In some example embodiments, the gel formulation does not include ethanol because the inclusion of ethanol is believed to prevent gelation of the formulation.

In some example embodiments, the vapor former included in the gel formulation is one or more of propylene glycol, glycerin, 1,3-propanediol, and combinations thereof. The vapor former may be included in an amount ranging from about 20% by weight based on the weight of the gel formulation to about 90% by weight based on the weight of the gel formulation. For example, the vapor former may be in the range of about 50% to about 80%, more preferably about 55% to about 75%, or most preferably about 60% to about 70%). In some example embodiments, the ethanol-free gel formulation may include a diol and glycerin. The diol may be one of propylene glycol, glycerin, 1,3-propanediol, and combinations thereof. In some example embodiments, the gel formulation may include a diol and glycerin included in a weight ratio that may range from about 1:4 to about 4:1. In some example embodiments, the weight ratio of a diol and glycerin included in the gel formulation may preferably be about 3:2. In some example embodiments, the gel formulation may include only propylene glycol, only 1,3-propanediol, or only glycerin.

In some example embodiments, the gel formulation includes water. Water may be included in an amount ranging from about 5% by weight based on the weight of the gel formulation to about 40% by weight based on the weight of the gel formulation, more preferably in an amount ranging from about 10% by weight based on the weight of the gel formulation to about 15% by weight based on the weight of the gel formulation.

In some example embodiments, the gel formulation may include at least one flavorant in an amount ranging from about 0.2% by weight based on the weight of the gel formulation to about 15% by weight based on the weight of the gel formulation. For example gel formulation may include at least one flavorant in an amount ranging from about 1% by weight based on the weight of the gel formulation to about 12% by weight based on the weight of the gel formulation, more preferably about 2% by weight based on the weight of the gel formulation to about 10% by weight based on the weight of the gel formulation, and most preferably about 5% by weight based on the weight of the gel formulation to about 8% by weight based on the weight of the gel formulation. The at least one flavorant may include one or more of a natural flavorant or an artificial ("synthetic") flavorant. In some example embodiments, the at least one flavorant is one or more of tobacco flavor, menthol, wintergreen, savory flavors, spicy flavors, cinnamon flavors, clove flavors, roasted flavors, peppermint, herb flavors, fruit flavors, nut flavors, liquor flavors, and combinations thereof. In some example embodiments, the at least one flavorant includes one or more of a tobacco flavor ingredient, a menthol flavor ingredient, a wintergreen flavor ingredient, a savory flavor ingredient, a spicy flavor ingredient, a cinnamon flavor ingredient, a clove flavor ingredient, a roasted flavor ingredient, a peppermint flavor ingredient, an herb flavor ingredient, a fruit flavor ingredient, a nut flavor ingredient, a liquor flavor ingredient, a natural extract, a lactone substance, pyrazine, vanillin, piperonal, a carbonyl substance, and combinations thereof.

In some example embodiments, the gel formulation includes at least one biopolymer in an amount ranging from about 0.01% by weight to about 2% by weight based on the weight of the gel formulation (e.g., about 0.01% to about 1.5%, about 0.15% to about 1.0% or about 0.2% to about 0.5%). In some example embodiments, the biopolymer includes, without limitation, one or more of agar, carrageenan (e.g. kappa carrageenan), sodium alginate, gellan gum, pectin, and combinations thereof. Any polymer capable of forming hydrogels, cross-linked hydrogels, thermo-reversible or nonreversible gels may be included in the gel formulation. In some example embodiments, the gel formulation may be at least partially cross-linked with a cross-linking agent. In some example embodiments, the biopolymer is a food grade biopolymer. In some example embodiments, the biopolymer is a carbohydrate.

In some example embodiments, the gel formulation includes nicotine. The nicotine may be included in the gel formulation in an amount ranging from about 1% by weight based on the weight of the gel formulation to about 10% by weight based on the weight of the gel formulation. For example, the nicotine may be included in the gel formulation in an amount ranging from about 2% by weight based on the weight of the gel formulation to about 9% by weight based on the weight of the gel formulation, more preferably about 2% by weight based on the weight of the gel formulation to about 8% by weight based on the weight of the gel formulation, or most preferably about 2% by weight based on the weight of the gel formulation to about 6% by weight based on the weight of the gel formulation. In some example embodiments, the gel formulation may be nicotine-free.

In some example embodiments, the gel formulation may include nicotine in an amount of greater than about 3% by weight based on the weight of the gel formulation. In some example embodiments, a gel formulation that includes nicotine may also include one or more acids. The one or more acids may be one or more of pyruvic acid, formic acid, oxalic acid, glycolic acid, acetic acid, isovaleric acid, valeric acid, propionic acid, octanoic acid, lactic acid, levulinic acid, sorbic acid, malic acid, tartaric acid, succinic acid, citric acid, benzoic acid, oleic acid, aconitic acid, butyric acid, cinnamic acid, decanoic acid, 3,7-dimethyl-6-octenoic acid, 1-glutamic acid, heptanoic acid, hexanoic acid, 3-hexenoic acid, trans-2-hexenoic acid, isobutyric acid, lauric acid, 2-methylbutyric acid, 2-methylvaleric acid, myristic acid, nonanoic acid, palmitic acid, 4-penenoic acid, phenylacetic acid, 3-phenylpropionic acid, hydrochloric acid, phosphoric acid, sulfuric acid and combinations thereof. The acid may be included in the gel formulation in an amount ranging from about 0.01% by weight based on the weight of the gel formulation to about 5.0% by weight based on the weight of the gel formulation.

In some example embodiments, a total amount of the gel formulation included in the electronic aerosol generating device 60 is selected so as to be capable of forming an aerosol over the course of about 1 to about 500 puffs (e.g. about 10 to about 350 puffs, about 20 to about 250 puffs, about 30 to about 200 puffs, about 30 to about 150 puffs, about 40 to about 140 puffs, or about 80 to about 120 puffs).

In addition, the gel formulation may have a density ranging from about 0.80 g/cm$^3$ to about 1.5 g/cm$^3$ (e.g. about 0.80 g/cm$^3$ to about 1.0 g/cm$^3$, about 0.90 g/cm$^3$ to about 1.4 g/cm$^3$, about 1.00 g/cm$^3$ to about 1.3 g/cm$^3$, or about 1.10 g/cm$^3$ to about 1.20 g/cm$^3$).

The gel formulation may be formed by dissolving one or more biopolymers, which may include agar, in an amount ranging from about 0.01% by weight based on the weight of the gel formulation to about 2% by weight based on the weight of the gel formulation in hot water having a temperature of about 99.9° C. while stirring until a clear solution is formed. The clear solution may then be maintained at about 99.9° C. until the clear solution is combined with the remaining components of the gel formulation.

While the temperature of the clear solution is maintained, the remaining components may be mixed to form a liquid system including the vapor former and water in the amounts indicated above. One or more flavorants may also be mixed with the remaining components to form the liquid system.

The liquid system may then be transferred to a sealed container and pre-heated to about 60° C. in a water bath to form a warm liquid system. The water bath may be maintained at about 63° C.

The warm liquid system may then be quickly added to the clear solution of the biopolymer and mixed with a high speed mixer for about 10 minutes to form a final homogeneous mixture having a temperature of about 60° C. The warm liquid system may be added to the clear solution of the biopolymer and mixed while remaining in the water bath.

The final homogeneous mixture may then be cooled in a cold water bath having a temperature of about 4° C. for about an hour to form a gel. For example, the final homogeneous mixture may be cooled after being injected (placed) directly into a reservoir or a cavity in an electronic aerosol generating device or injected (placed) into a mold to form a gel formulation having a particular size and shape. The size and shape may correspond to a size and shape that may be inserted into a cavity or reservoir of an e-vaping device as described herein.

In some example embodiments, to automate manufacture, the gel formulation may be injected into the reservoir 314 before the gel cools to room temperature and sets.

Figure 3:
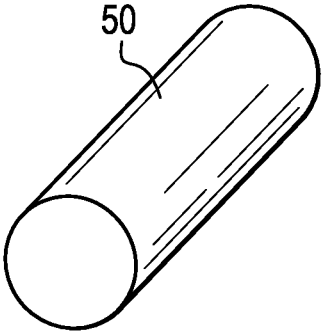
FIG. 3 is a perspective view of a cylindrical gel formulation, according to some example embodiments.
Figure 4:
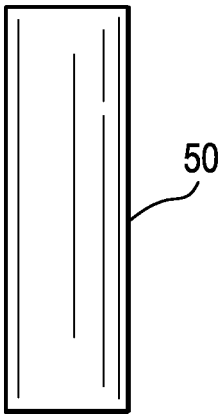
FIG. 4 is a longitudinal cross-sectional view of the cylindrical gel formulation of FIG. 3.

FIG. 3 is a perspective view of a cylindrical gel formulation, according to some example embodiments. FIG. 4 is a longitudinal cross-sectional view of the cylindrical gel formulation of FIG. 3.

In some example embodiments, including the illustrated embodiment shown in FIGS. 3-4, a gel formulation may include a cylindrical body 50 that is sized and configured for insertion into a cavity or reservoir of an electronic aerosol generating device 60 as described herein. The cylindrical body 50 may be one or more of a pre-formed cylindrical body or a molded cylindrical body. In some example embodiments, the gel formulation may be in one or more other shapes including one or more of rectangular, square, oval or any other desired shape. In some example embodiments, the size of the pre-formed and/or molded cylindrical body 50 may be associated with a desired number of puffs provided to an adult vaper by the gel formulation body 50, such that the size of a body 50 may be selected based on a desired number of puffs.

In some example embodiments, one or more fibers or particles may be added to the body of the gel formulation. The one or more fibers or particles included in the body of the gel formation may abate a tendency of the gel formulation to release liquid at ambient conditions or to leak liquid through a reservoir containing the gel formulation at one or more temperatures. In some example embodiments, the one or more fibers or particles included in the body of the gel formation may abate any tendency of the gel formulation to release liquid at ambient conditions or to leak liquid through a reservoir containing the gel formulation at any temperatures.

Figure 5:
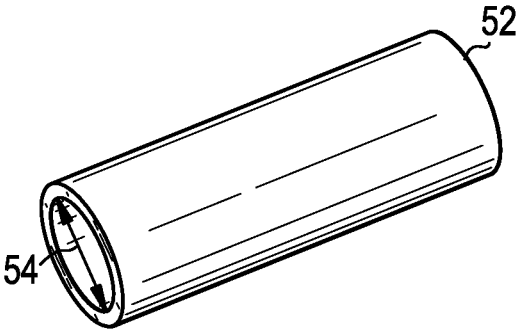
FIG. 5 is a perspective view of an embodiment of a tubular gel formulation, according to some example embodiments.
Figure 6:
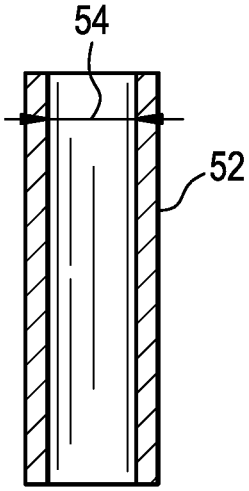
FIG. 6 is a longitudinal cross-sectional view of the tubular gel formulation of FIG. 5.

FIG. 5 is a perspective view of an embodiment of a tubular gel formulation, according to some example embodiments. FIG. 6 is a longitudinal cross-sectional view of the tubular gel formulation of FIG. 5.

In some example embodiments, including the illustrated embodiment shown in FIGS. 5-6, the gel formulation may include a tubular body 52 having a hollow core 54 therein. The tubular body 52 may be one or more of a pre-formed tubular body or a molded tubular body. The diameter of the hollow core 54 may be adjustable to enable a heater to be inserted into the hollow core 54. The diameter of the hollow core 54 may range from about 2 mm to about 10 mm, more preferably from about 3 mm to about 9 mm, more preferably from about 4 mm to about 8 mm, or most preferably from about 5 mm to about 7 mm. The tubular body 52 may be configured for insertion into a cavity of an e-vaping device. The tubular body 52 may be configured to be inserted into the reservoir 314 of the first section 70 of the e-vaping device described herein. In some example embodiments, the size of the pre-formed and/or molded tubular body 52 may be associated with a desired number of puffs provided to an adult vaper by the gel formulation included in the tubular body 52, such that the size of a tubular body 52 may be selected based on a desired number of puffs. The tubular body 52 may be placed in a reservoir. In some example embodiments, the tubular body may be configured to be placed in the outer housing 22, and the inner tube 362 may be excluded from the first section 70.

Where the tubular body is configured to be placed in a first section 70 of an e-vaping device, the tubular body 52 may be configured to enable a vapor to pass through the hollow core to the mouth end insert 20 and out of the e-vaping device, where the vapor is generated in the section 70 during vaping. In some example embodiments, the tubular body 52 is configured to enable the vapor to pass around an external surface of the tubular body 52.

In some example embodiments, including embodiments shown in FIGS. 7-16, the e-vaping device 60 includes a first section 70, where the first section 70 lacks an inner tube 362, heater coil 319, and wick 328 shown in FIG. 2. In some example embodiments, the e-vaping device 60 includes at least one or more of the cylindrical body 50 or tubular body 52 of gel formulation. The body may be pre-formed and/or molded. The body may include a gel formulation that independently retains its shape. The body 50, 52 may be inserted into the housing of the first section 70 at a location adjacent the location in the first section 70 where a heater 319 is shown to be located in FIG. 2. The first section 70 may include a heater that may be in contact with the pre-formed and/or molded body 50, 52 of gel formulation as shown in greater detail in FIGS. 7-16 discussed below. The heater may be a low temperature heater that is configured to heat the gel formulation included in the body 50, 52 to a temperature ranging from about 150° C. to about 350° C. to volatilize the released liquid or semi-liquid component of the gel formulation, more preferably under 300° C. (e.g. about 160° C. to about 190° C. or about 170° C. to about 180° C.).

In some example embodiments, the heater 65 may include one or more other heater shapes, including serpentine heaters, which may contact the end surface 63 of the cylindrical body 50.

In some example embodiments, a heater 65 is a resistive heater. In some example embodiments, a heating element of a resistive heater may be one or more of a wire or a resistive trace. A resistive heater 65 may be constructed from a selected material and may have one or more selected physical structure parameters based on one or more dimensional parameters of the gel formulation. The selected material of the heater 65 may be one or more metals or alloys. For example, the selected material may include one or more of Ni, Cr, Al, Fe, Mn, Si, C, Mo, Cu, Ti, Co, W and Nb. Different metals or alloys may be associated with different electrical properties, thermal properties, and toxicological properties. A resistive heater 65 may be constructed from a selected material based on one or more of said properties with regard to one or more elements of the e-vaping device 60, including one or more elements of the gel formulation. A resistive heater 65 may be constructed from a selected material based on a material composition of the gel formulation. In some example embodiments, the heater 65 may be constructed from a suitable electrically conductive and resistive material, including a fine nichrome wire. A selected physical structure parameter of the heater 65 may include one or more of a diameter of a wire included in the heater 65, a length of a wire in the heater 65, a number of turns of a coiled wire in the heater 65, a spacing of adjacent turns in a coiled wire in the heater 65, a number of wave patterns of a wire in the heater 65, a size of individual wave patterns of a wire in the heater 65, and some combination thereof. In some example embodiments, a wire included in a heater 65 includes a wire having a gauge size between about 16 to about 34. In some example embodiments, where the heater 65 is a resistive heater, the heater 65 may have a resistance between about 0.2 ohms to about 4.0 ohms, inclusively.

Figure 7:
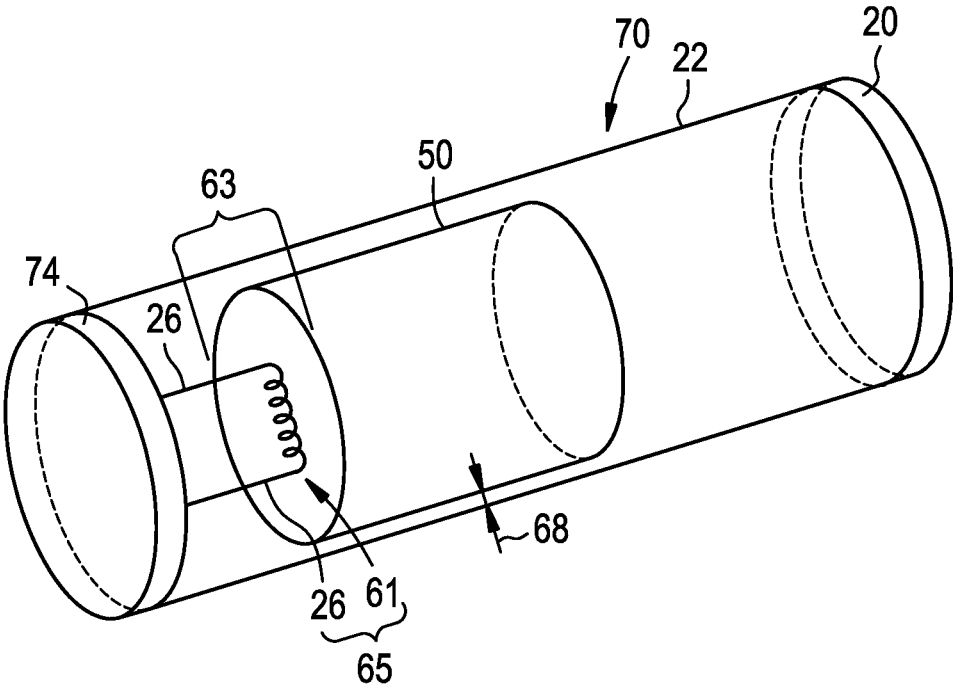
FIG. 7 is a perspective view of an e-vaping device first section that includes a cylindrical gel formulation and heater, according to some example embodiments.

In some example embodiments, the heater 65 shown in FIG. 7 may include a coiled heater 61 constructed of fine nichrome wire, where the nichrome wire is wound in a coil having between 5-8 turns inclusively, and where adjacent turns in the coil are spaced apart by about 0.4 mm.

FIG. 7 is a perspective view of an e-vaping device first section that includes a cylindrical gel formulation and heater, according to some example embodiments. As shown in FIG. 7, the first section 70 may include the cylindrical body 50, placed adjacent to heater 65. As shown in FIG. 7, the heater 65 may include a wire coil heater 61 having electrical leads 26 extending therefrom to an interface 74 of the first section 70. The interface 74 may be configured to form an electrical connection with the power supply 12 (shown in FIG. 2), based on the first section 70 and second section 72 being coupled. The cylindrical body 50 may or may not be contained in a reservoir, including the reservoir 314 shown in FIG. 2. The wire coil heater 61 may contact a surface of the cylindrical body 50. In the illustrated embodiment, for example, the wire coil 61 contacts an end surface 63 of the body 50. However, it will be understood that the wire coil heater 61 may contact any surface of the cylindrical body 50. Based at least in part upon the wire coil heater 61 contacting a surface of the cylindrical body 50, a wick may be absent from the first section 70.

Figure 8:
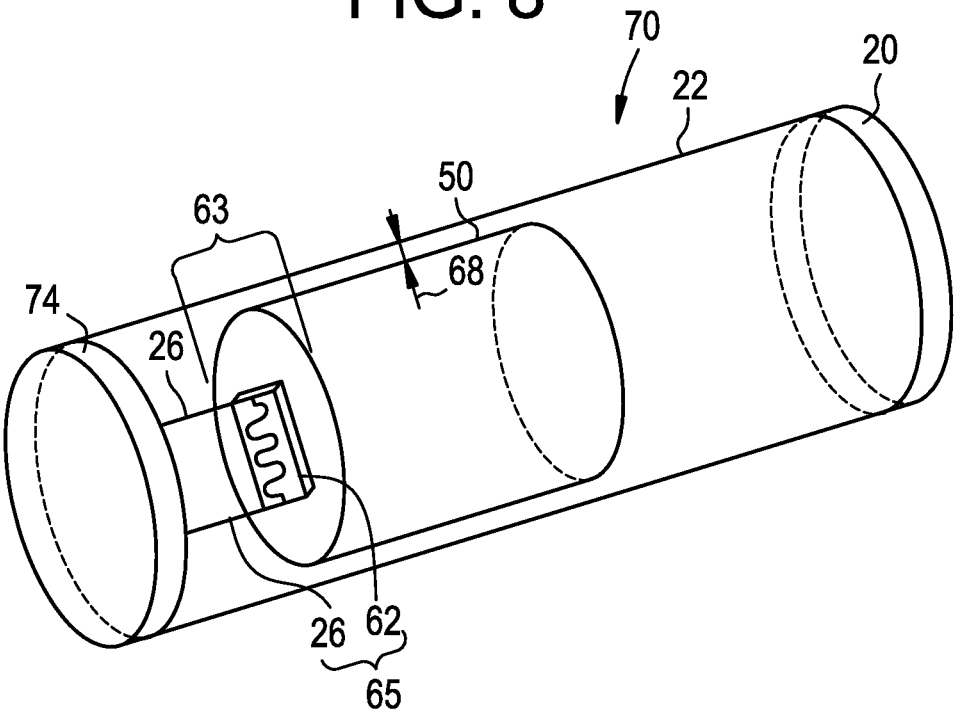
FIG. 8 is a perspective view of an e-vaping device first section that includes a cylindrical gel formulation and heater, according to some example embodiments.

FIG. 8 is a perspective view of an e-vaping device first section that includes a cylindrical gel formulation and heater, according to some example embodiments. As shown in FIG. 8, the first section 70 may include the cylindrical body 50 and a heater 65 that includes a surface planar heater 62 that contacts a planar end surface 63 of the cylindrical body 50 and has electrical leads 26 extending therefrom to an interface 74. The interface 74 may be configured to form an electrical connection with the power supply 12 (shown in FIG. 2), based on the first section 70 and second section 72 being coupled. The cylindrical body 50 may or may not be contained in a reservoir, including the reservoir 314 shown in FIG. 2. Based at least in part upon the surface planar heater 62 contacting a planar end surface 63 of the cylindrical body 50, a wick may be absent from the first section 70. The surface planar heater may include a heater element arranged in one or more patterns. The one or more patterns may include a wave pattern. The wave pattern may include a sinusoidal wave pattern of heater elements.

Figure 9:
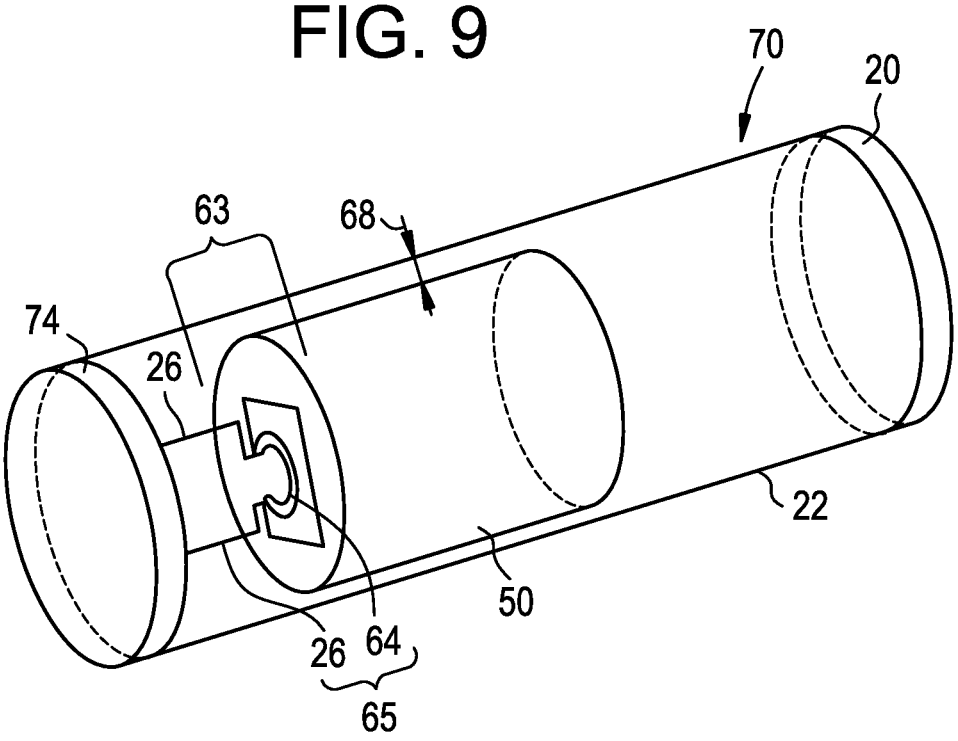
FIG. 9 is a perspective view of an e-vaping device first section that includes a cylindrical gel formulation and heater, according to some example embodiments.

FIG. 9 is a perspective view of an e-vaping device first section that includes a cylindrical gel formulation and heater, according to some example embodiments. As shown in FIG. 9, the first section 70 may include the cylindrical body 50 and a heater 65 that includes a ring shaped, planar heater 64 that contacts a surface 63 of the cylindrical body 50 and has electrical leads 26 extending therefrom to an interface 74. The ring shaped, planar heater may include a heater element which is arranged in a ring pattern. The ring pattern may be a partial ring pattern, where the heater elements extend along a portion of a full ring shape. For example, as shown in FIG. 9, the heater 64 is "C" shaped. The wave pattern may include a sinusoidal wave pattern of heater elements. The interface 74 may be configured to form an electrical connection with the power supply 12 (shown in FIG. 2), based on the first section 70 and second section 72 being coupled. The cylindrical body 50 may or may not be contained in a reservoir, including the reservoir 314 shown in FIG. 2. Based at least in part upon the surface planar heater 62 contacting a planar end surface 63 of the cylindrical body 50, a wick may be absent from the first section 70.

In some example embodiments, the heater 65 may include one or more other heater shapes, including serpentine heaters, which may contact the end surface 63 of the cylindrical body 50.

In some example embodiments, a planar heater, conformal heater, etc. includes a solid state heater. A solid state heater may include a heating element that is one or more sets of resistive traces. A solid state heater may be a ceramic solid state heater. A solid state heater may be constructed from a combination of platinum and at least one ceramic material. A solid state heater may have a three-dimensional heating element geometric structure. A solid state heater may include multiple separate heating elements. A solid state heater may include an aluminum nitride ceramic material. A solid state heater may include a ceramic material and one or more internal resistance traces. A resistance trace may be constructed from tungsten. A solid state heater may include Aluminum nitride (ALN) ceramic and tungsten. Where a solid state heater includes ALN and tungsten, the tungsten metal and ALN may be bonded via chemical bonding. An oxide phase may be inter-diffused between the ALN and Tungsten metal.

A solid state heater may have a linear coefficient of expansion per degree Celsius of about $4.3\times10^{-6}$. A solid state heater may have a DC breakdown of 14 KV/mil, a Young's Modulus of about 322 GPa, a flexural strength of about 350 MPa, a thermal conductivity of about 130 W/m-k at 200 degrees Celsius, a thermal conductivity of about 180 W/m-k at room temperature, a dielectric loss of about $1.2\times10^{-4}$ at room temperature and a frequency of 1 mhz, a dielectric constant of about 8.5-8.7 at room temperature and a frequency of 1 mhz, and some combination thereof. In some example embodiments, a planar heater includes a planar metal surface heater.

In some example embodiments, as the vapor is generated, the vapor may pass around an external surface of the cylindrical body 50, such as through a space 68 defined between an external surface of the cylindrical body 50 and an internal surface of the outer housing 22.

Figure 10:
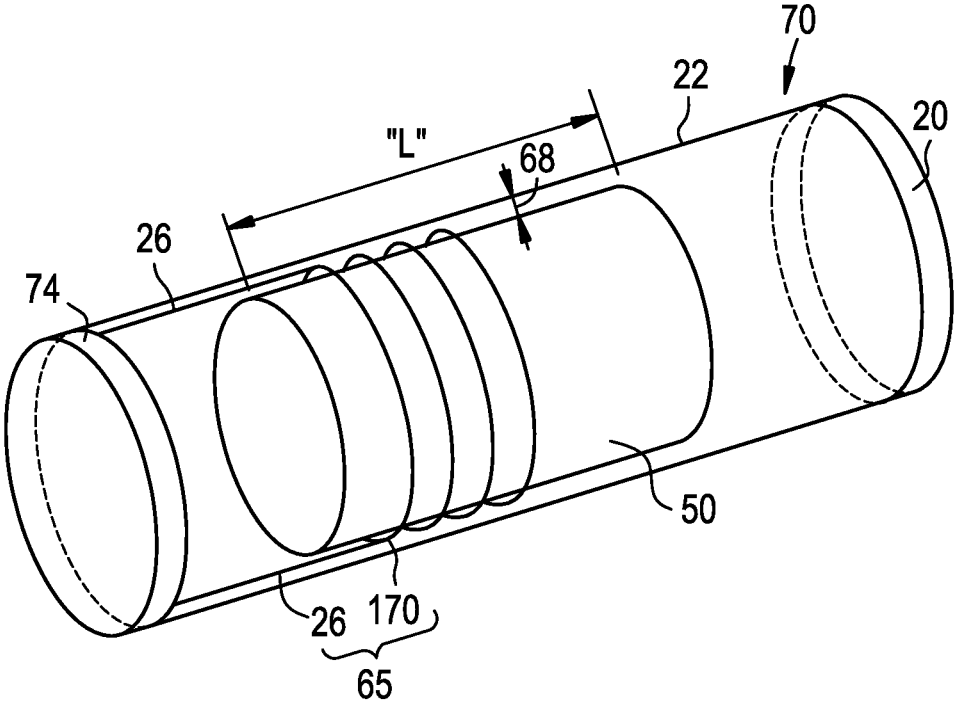
FIG. 10 is a perspective view of an e-vaping device first section that includes a cylindrical gel formulation and heater, according to some example embodiments.
Figure 11:
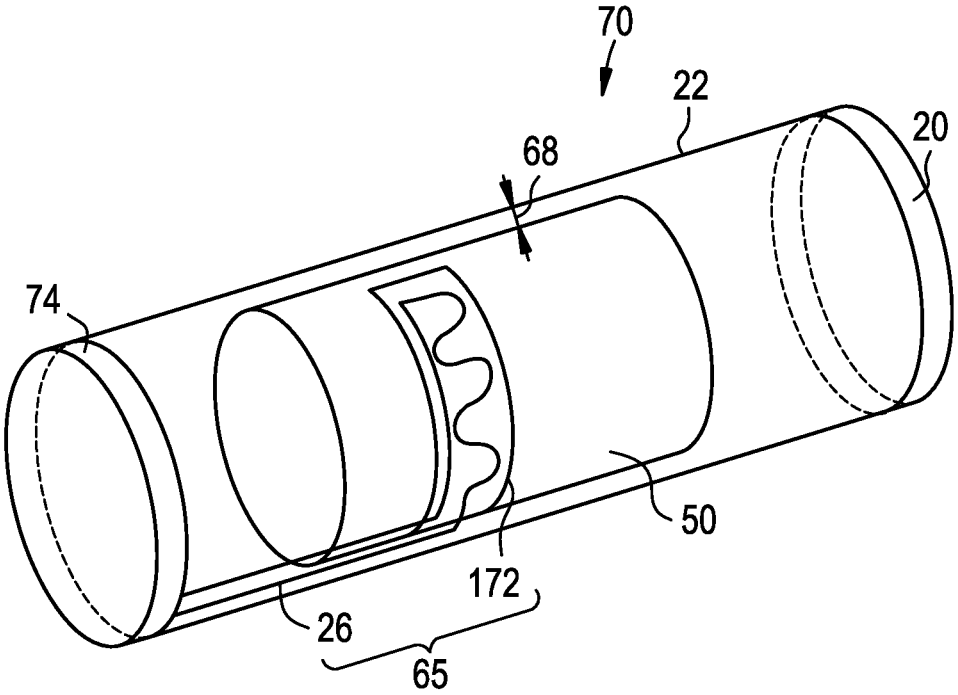
FIG. 11 is a perspective view of an e-vaping device first section that includes a cylindrical gel formulation and heater, according to some example embodiments.
Figure 12:
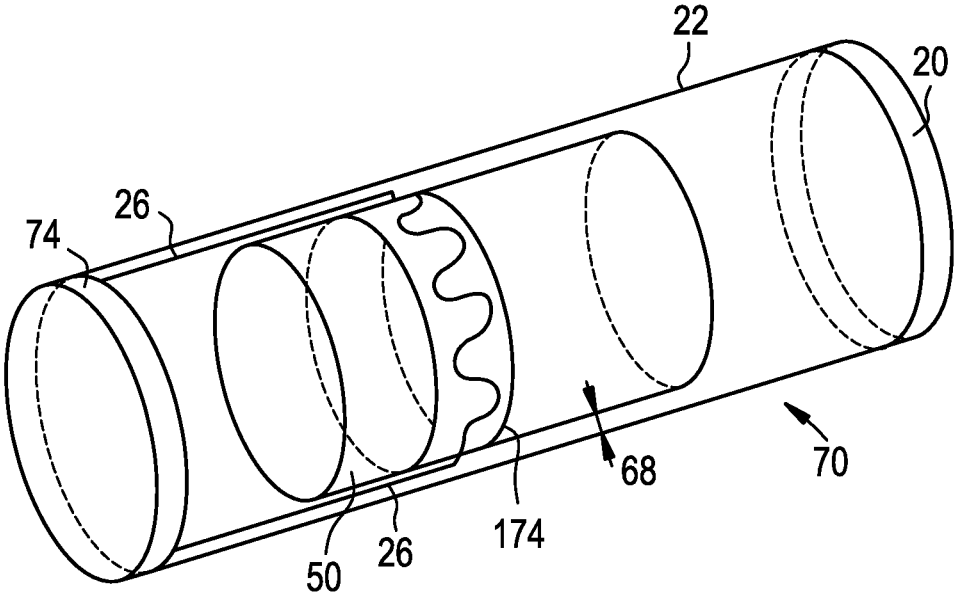
FIG. 12 is a perspective view of an e-vaping device first section that includes a cylindrical gel formulation and heater, according to some example embodiments.
Figure 13:
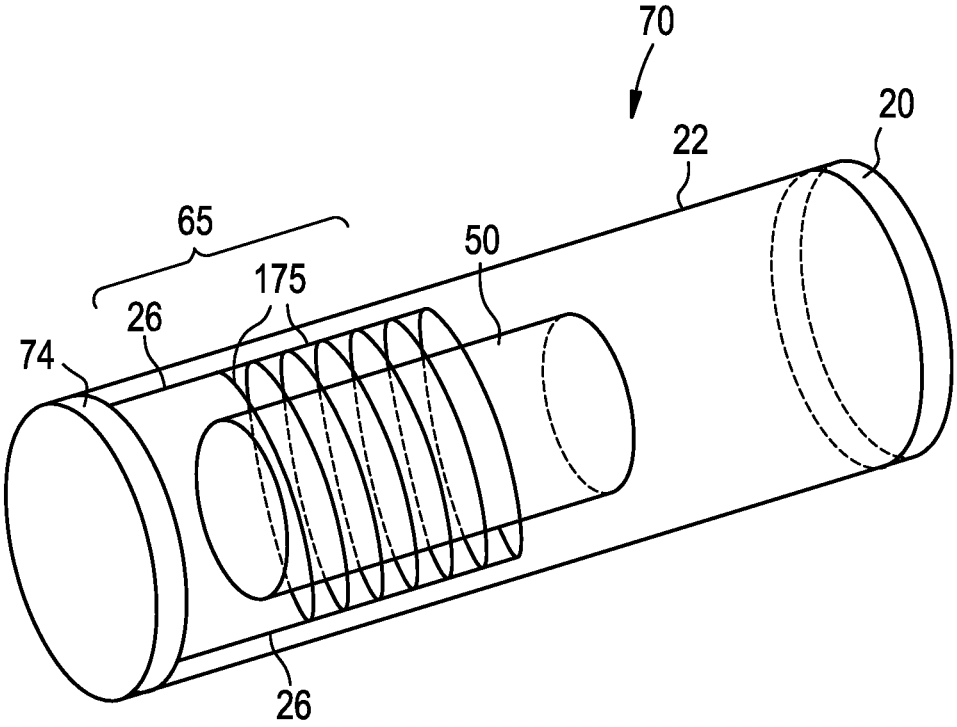
FIG. 13 is a perspective view of an e-vaping device first section that includes a cylindrical gel formulation and heater, according to some example embodiments.

FIG. 10 is a perspective view of an e-vaping device first section that includes a cylindrical gel formulation and heater, according to some example embodiments. FIG. 11 is a perspective view of an e-vaping device first section that includes a cylindrical gel formulation and heater, according to some example embodiments. FIG. 12 is a perspective view of an e-vaping device first section that includes a cylindrical gel formulation and heater, according to some example embodiments. FIG. 13 is a perspective view of an e-vaping device first section that includes a cylindrical gel formulation and heater, according to some example embodiments.

In some example embodiments, including the embodiments shown in FIGS. 10, 11, 12 and 13, the heater 65 may be at least partially wrapped about a circumference of the cylindrical body 50. Such a heater 65 may extend along at least a portion of a length ("L") of the cylindrical body 50. For example, as shown in FIG. 10, the heater 65 may include a coil heater 170 that is wrapped about the circumference of the cylindrical body 50. The coil heater 170 may include a particular quantity of coils around the cylindrical body 50. The coil heater 170 may be spaced a particular distance from the surface of the cylindrical body 50. The coils may be spaced a particular distance apart.

As shown in FIG. 11, the heater 65 may include a conformal, planar surface heater 172 that is in contact with a portion of an outer circumference of the cylindrical body 50. The conformal planar surface heater 172 may extend along a particular proportion of the body 50 circumference. The conformal planar surface heater 172 may include a heater element arranged in one or more patterns. The one or more patterns may include a wave pattern. The wave pattern may include a sinusoidal wave pattern of heater elements. The sinusoidal waves included in the sinusoidal wave pattern may be spaced apart by a particular distance. The conformal ring surface heater may extend along a particular proportion of a length "L" of the cylindrical body 50.

As shown in FIG. 12, the heater 65 may include a conformal ring surface heater 174 that extends completely around the circumference of the cylindrical body 50. The conformal ring surface heater 174 may include a heater element arranged in one or more patterns. The one or more patterns may include a wave pattern. The wave pattern may include a sinusoidal wave pattern of heater elements. The sinusoidal waves included in the sinusoidal wave pattern may be spaced apart by a particular distance. The conformal ring surface heater may extend along a particular proportion of a length "L" of the cylindrical body 50. In some example embodiments, the heaters 170, 712 are resistive heaters.

A conformal heater, planar heater, etc. may be a flexible heater. A flexible heater may be a thick film heater constructed of one or more thick films. A flexible heater may include one or more resistive traces arranged in a pattern of resistive traces on a substrate. The substrate may be a flexible substrate. The flexible heater may include one or more adhesive layers configured to bond the flexible heater to a surface, including a gel formulation surface. An adhesive layer may include a pressure sensitive adhesive (PSA) layer.

A thick film heater may be a printed thick film heater where a pattern of resistive traces included in the thick film heater is a pattern of an ink material printed on a film substrate layer. The ink material may include a resistive ink. The film may include a PSA layer applied to the substrate on which the ink is printed. The thick film heater may include another layer laminated to the substrate and ink layer with the PSA layer. In some example embodiments, a film layer includes a 0.05-inch thick thermoplastic or thermoset polymer substance, where the substance is configured to exhibit thermal conductivity while providing electrical insulation. For example, the film layer may be formed of polyester or polyimide. An additional layer of PSA may be applied to an exterior surface of the thick film heater, such that the thick film heater may be bonded directly to the gel formulation, thereby enhancing thermal transfer between the heater 65 and the gel formulation.

In some example embodiments, a thick film heater includes a substrate constructed from one or more of polyester, polyethylene, polyvinyl chloride, thermoset laminate, polyethylene napthalate, polyimide, silicone rubber, or some combination thereof. A thick film heater may include a PSA layer formed of one or more of acrylic materials or silicone materials. A thick film heater may have a minimum width of 6 mm. A thick film heater may have a dielectric strength of up to 1500 VAC. A thick film heater may have a watt density of up to 25 W/square inches. A thick film heater may have an operating voltage of up to about 277 VAC or 277 VDC. A thick film heater may have an overall maximum operating temperature of about 482 degrees Celsius.

In some example embodiments, a flexible heater includes one or more of a single-sided heater, a double-sided heater, a multi-layer heater, a rigid-flex heater, and some combination thereof. A single sided heater includes a single heating element layer, which may be a resistive trace. A double sided heater includes two heating element layers. A flexible heater may include a sculptured heating element, where a sculptured heating element has variable thickness through the heater structure. A sculptured heating element may have bare metal portions exposed from the heater structure. A rigid-flex heater includes at least one rigid layer and at least one flexible layer. A flexible heater may have a thickness of at least 0.004 inches. A flexible heater may include at least two parallel traces having different resistances. The parallel traces may be separately, selectively activated to provide different rates of heating. A flexible heater may have a bend radius that is about 10 times the thickness of the flexible heater. One or more heating elements in the flexible heater may be radiused resistive traces. Where a flexible heater includes multiple layers of parallel heating elements, the separate layers may have a staggered configuration, thereby providing augmented flexibility of the flexible heater.

As shown in FIG. 13, the heater 65 may include an inductive coil heater 175 that does not contact a surface of the cylindrical body 50. The inductive coil heater 175 may be referred to as being isolated from contacting a surface of the cylindrical body 50. The inductive coil heater 175 may be configured to heat the gel formulation included in the cylindrical body 50 to a temperature sufficient to release a liquid/semi-liquid component from the gel formulation. The released component may then be vaporized by at least some heat generated by the heater 65 to generate the vapor. The inductive coil heater 175 may include a particular quantity of coils around the cylindrical body 50. The inductive coil heater 175 coils may be spaced a particular distance from the surface of the cylindrical body 50.

A heater that includes an inductive coil heater 175 may be configured to apply inductive heating by transferring energy from a primary coil (not shown in FIG. 13) to the coil heater 175, where the coil heater 175 is a secondary coil.

Figure 14:
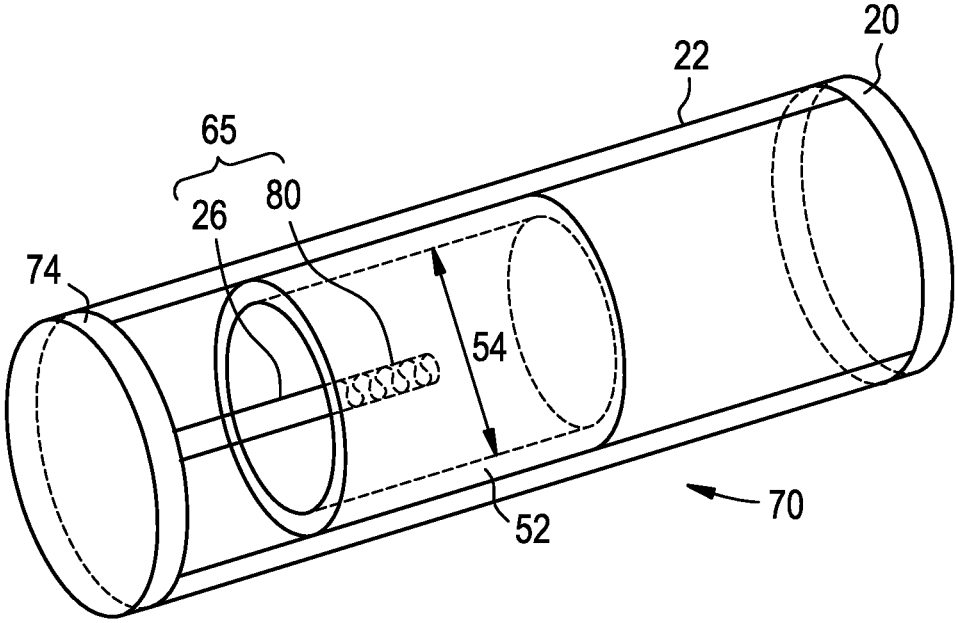
FIG. 14 is a perspective view of an e-vaping device first section that includes a tubular gel formulation and heater, according to some example embodiments.
Figure 15:
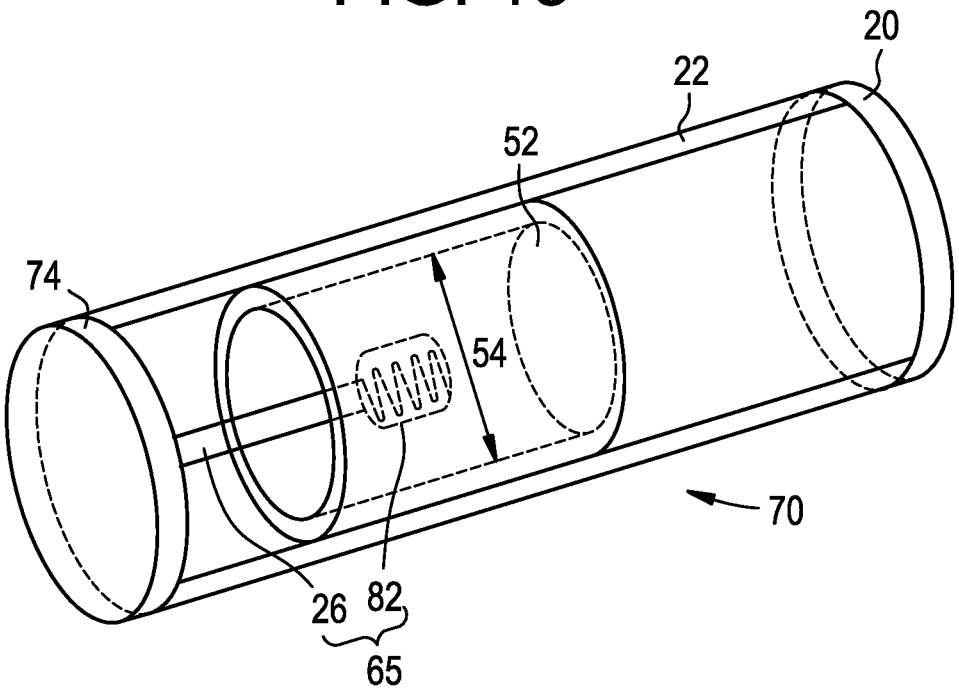
FIG. 15 is a perspective view of an e-vaping device first section that includes a tubular gel formulation and heater, according to some example embodiments.

FIG. 14 is a perspective view of an e-vaping device first section that includes a tubular gel formulation and heater, according to some example embodiments. FIG. 15 is a perspective view of an e-vaping device first section that includes a tubular gel formulation and heater, according to some example embodiments. In some example embodiments, including the embodiments shown in FIGS. 14-15, the first section 70 may include the tubular body 52 and a heater 65. As further shown in FIGS. 14-15, the heater may be a heater coil 80 or a surface planar heater 82 inserted into the hollow core 54 of the tubular body 52. In some example embodiments, a surface planar heater 82 includes one or more of a solid state heater, a flexible heater, and some combination thereof. In some example embodiments, the heater 65 may be a heater rod (not shown). As shown in FIGS. 14-15, the tubular body 52 may be friction fit within the housing 22 and the heater 65 may be held within the hollow core 54 of the tubular body 52. Where a vapor is formed in a first section 70 which includes a tubular body 52, including the illustrated embodiments of FIGS. 14-15, the vapor may flow through the core 54 of the tubular body 52 to the mouth end insert 20 and out of the e-vaping device which includes the first section 70.

In some example embodiments, electrical power is supplied to the heater 65 from the power supply included in the second section 72 via an interface 74 coupled to the second section and electrical leads 26 coupled to the interface 74. Power may be supplied to the heater 65 in response to a puff sensed by a puff sensor 16 as described above with respect to FIG. 2. In some example embodiments, power may be supplied to the heater 65 in response a push button included on one or more of the sections 70, 72 being operated. In some example embodiments, the heaters 80, 82 are resistive heaters.

Figure 16:
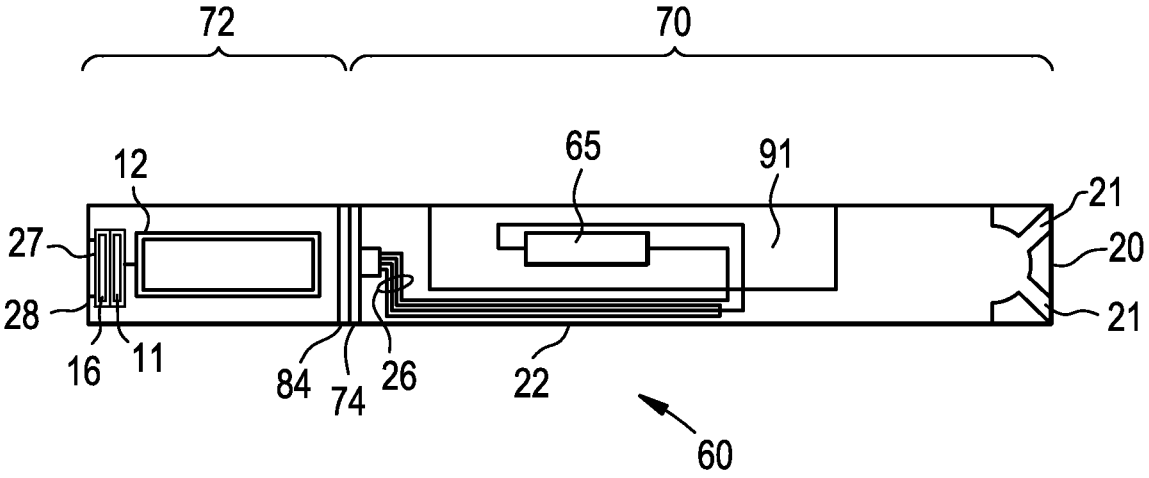
FIG. 16 is a side cross-sectional view of an e-vaping device, according to some example embodiments.

FIG. 16 is a side cross-sectional view of an e-vaping device, according to some example embodiments. As shown in FIG. 16, a gel formulation 91 may be positioned within the housing 22 of a first section 70, and the heater 65 included in the first section 70 may contact a side surface of the gel formulation 91. The gel formulation 91 may include one or more of a cylindrical body or a tubular body. The heater 65 may heat the gel formulation 91 to vaporize at least a portion of the gel formulation to form a vapor. As the vapor is formed the vapor may pass along a side of the gel formulation to a mouth end insert 20 of the first section 70, via which the vapor may exit the e-vaping device 60. The first section includes electrical leads 26 coupling the heater 65 to interface 74.

In some example embodiments, the heater 65 may contact the gel formulation 91 included in a cylindrical or tubular body 50, 52 of a first section. In some example embodiments, a first section 70 may include a wick that couples one or more portions of the gel formulation 91 included in a cylindrical or tubular body 50, 52 of the first section 70 to the heater 65. The wick may include a filamentary wick.

While some liquid formulations for use in e-vaping devices may include biopolymers, gels cannot be formed when such formulations include ethanol therein. It has been found that when combining the ingredients in Table 1 below, according to the process described below, colloidal suspensions were formed, but no gel or gelation was observed.

TABLE 1

| | Sample ID | | | | | |
|---|---|---|---|---|---|---|
| | A | | | B | | |
| | Calc. | wt % | Real | Calc. | wt % | Real |
| $W_{agar}$ (g) | 0.0169 | 0.225 | 0.0169 | 0.0214 | 0.225 | 0.0213 |
| $W_{H2O}$ (g) | 1 | 13.303 | 0.999 | 1 | 10.503 | 0.999 |
| $W_{PG}$ (g) | 3 | 39.910 | 3.02 | 3 | 31.508 | 3.03 |
| $W_{Gly}$ (g) | 2.5 | 33.258 | 2.54 | 2.5 | 26.257 | 2.54 |
| $W_{EtOH}$ (g) | 1 | 13.303 | 1.01 | 3 | 31.508 | 3.05 |

To determine whether a solution including ethanol could form a gel, the ingredients of Table 1 were combined as follows. The agar for each of Sample A and Sample B was transferred into a 20 mL vial containing water. The mixture was heated to 90° C. to allow the agar to dissolve in the water under mild stirring. The propylene glycol, glycerol and ethanol were then added to the hot agar solution, which was then allowed to cool down to room temperature overnight. Neither Sample A nor Sample B showed any signs of gel or gelation, and each was in the form of a colloidal suspension.

Accordingly, the gel formulation, as described herein may at least partially exclude ethanol. In some example embodiments, the gel formulation is ethanol-free.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A cartridge for an e-vaping device, the cartridge comprising:

an ethanol-free gel formulation, the ethanol-free gel formulation does not include ethanol, the ethanol-free gel formulation including a vapor former included in an amount ranging from about 40% by weight based on the weight of the ethanol-free gel formulation to about 90% by weight based on the weight of the ethanol-free gel formulation, water, and a biopolymer included in an amount ranging from about 0.2% by weight based on the weight of the ethanol-free gel formulation to about 0.4% by weight based on the weight of the ethanol-free gel formulation, the biopolymer including agar, kappa carrageenan, gelatin, sodium alginate, gellan gum, pectin, or any combination thereof; and a heater configured to heat the ethanol-free gel formulation to form a vapor.

2. The cartridge of claim 1, wherein the vapor former is included in the ethanol-free gel formulation in an amount ranging from about 50% by weight based on the weight of the ethanol-free gel formulation to about 80% by weight based on the weight of the ethanol-free gel formulation.

3. The cartridge of claim 1, wherein the water is included in the ethanol-free gel formulation in an amount ranging from about 5% by weight based on the weight of the ethanol-free gel formulation to about 40% by weight based on the weight of the ethanol-free gel formulation.

4. The cartridge of claim 3, wherein the water is included in the ethanol-free gel formulation in an amount ranging from about 10% by weight based on the weight of the ethanol-free gel formulation to about 15% by weight based on the weight of the ethanol-free gel formulation.

5. The cartridge of claim 1, wherein the ethanol-free gel formulation further includes a flavorant.

6. The cartridge of claim 5, wherein the flavorant is included in the ethanol-free gel formulation in an amount ranging from about 0.2% by weight based on the weight of the ethanol-free gel formulation to about 15% by weight based on the weight of the ethanol-free gel formulation.

7. The cartridge of claim 5, wherein the flavorant includes a natural flavorant, an artificial flavorant, or both a natural flavorant and an artificial flavorant.

8. The cartridge of claim 5, wherein the flavorant includes a tobacco flavor ingredient, a menthol flavor ingredient, a wintergreen flavor ingredient, a savory flavor ingredient, a spicy flavor ingredient, a cinnamon flavor ingredient, a clove flavor ingredient, a roasted flavor ingredient, a peppermint flavor ingredient, an herb flavor ingredient, a fruit flavor ingredient, a nut flavor ingredient, a liquor flavor ingredient, a natural extract, a lactone substance, pyrazine, vanillin, piperonal, a carbonyl substance, or any combination thereof.

9. The cartridge of claim 1, wherein the ethanol-free gel formulation further includes nicotine.

10. The cartridge of claim 9, wherein the nicotine is included in the ethanol-free gel formulation in an amount ranging from about 1% to about 10% by weight based on the weight of the ethanol-free gel formulation.

11. The cartridge of claim 10, wherein the nicotine is included in the ethanol-free gel formulation in an amount ranging from about 1.5% to about 4.5% by weight based on the weight of the ethanol-free gel formulation.

12. The cartridge of claim 11, wherein the ethanol-free gel formulation includes nicotine in an amount of at least about 3% by weight based on the weight of the ethanol-free gel formulation, and the ethanol-free gel formulation further includes an acid in an amount ranging from about 0.01% by weight based on the weight of the ethanol-free gel formulation to about 5.0% by weight based on the weight of the ethanol-free gel formulation, the acid includes pyruvic acid, formic acid, oxalic acid, glycolic acid, acetic acid, isovaleric acid, valeric acid, propionic acid, octanoic acid, lactic acid, levulinic acid, sorbic acid, malic acid, tartaric acid, succinic acid, citric acid, benzoic acid, oleic acid, aconitic acid, butyric acid, cinnamic acid, decanoic acid, 3,7-dimethyl-6-octenoic acid, 1-glutamic acid, heptanoic acid, hexanoic acid, 3-hexenoic acid, trans-2-hexenoic acid, isobutyric acid, lauric acid, 2-methylbutyric acid, 2-methylvaleric acid, myristic acid, nonanoic acid, palmitic acid, 4-penenoic acid, phenylacetic acid, 3-phenylpropionic acid, hydrochloric acid, phosphoric acid, sulfuric acid, or any combination thereof.

13. The cartridge of claim 1, wherein at least a portion of the biopolymer is cross-linkable.

14. The cartridge of claim 1, wherein the ethanol-free gel formulation includes a diol and glycerin, the ethanol-free gel formulation including the diol and glycerin in a range of ratios between about 1:4 and 4:1, the diol including propylene glycol, glycerin, 1,3-propanediol, or any combination thereof.

15. The cartridge of claim 14, wherein the ethanol-free gel formulation includes the diol and glycerin in a ratio of about 3:2.

16. The cartridge of claim 1, wherein the ethanol-free gel formulation is included in a cylindrical body.

17. The cartridge of claim 16, wherein the heater is a wire coil heater contacting a surface of the cylindrical body.

18. An e-vaping device, the e-vaping device comprising:

a first section, the first section including a reservoir containing an ethanol-free gel formulation, the ethanol-free gel formulation does not include ethanol, the ethanol-free gel formulation including, a vapor former included in an amount ranging from about 40% by weight based on the weight of the ethanol-free gel formulation to about 90% by weight based on the weight of the ethanol-free gel formulation, water, and a biopolymer included in an amount ranging from about 0.2% by weight based on the weight of the ethanol-free gel formulation to about 0.4% by weight based on the weight of the ethanol-free gel formulation, the biopolymer includes agar, kappa carrageenan, gelatin, sodium alginate, gellan gum, pectin, or any combination thereof, and a heater configured to heat the ethanol-free gel formulation to form a vapor; and a second section, the second section including a power supply, the power supply configured to supply electrical power to the heater, and a control circuitry configured to control a supply of the electrical power to the heater.

19. The e-vaping device of claim 18, wherein the first and second sections include respective interfaces, the interfaces being configured to couple the first section and the second section together, the interfaces being further configured to electrically couple the heater to the power supply.

* * * * *